US005347796A

United States Patent [19]

Ziegler et al.

[11] Patent Number: 5,347,796

[45] Date of Patent: Sep. 20, 1994

[54] CROSS LOADING APPARATUS FOR USE WITH CARTONING SYSTEMS

[75] Inventors: Kelly W. Ziegler, Crosby; Clayton C. Alexson, Nisswa; Curt W. Lovold, Warroad, all of Minn.

[73] Assignee: Riverwood International Corporation, Atlanta, Ga.

[21] Appl. No.: 56,669

[22] Filed: May 3, 1993

Related U.S. Application Data

[63] Continuation-in-part of Ser. No. 856,450, Mar. 24, 1992, Pat. No. 5,241,806.

[51] Int. Cl.[5] ..... B65B 35/44; B65B 35/40; B65B 39/14

[52] U.S. Cl. ..... 53/566; 53/252; 53/258

[58] Field of Search ..... 53/252, 251, 250, 566, 53/564, 258, 255, 249, 468, 458, 473

[56] References Cited

U.S. PATENT DOCUMENTS

| | | | |
|---|---|---|---|
| 2,972,842 | 2/1961 | Hitchcock | 53/566 X |
| 3,060,659 | 10/1962 | Blais et al. | 53/566 |
| 3,879,920 | 4/1975 | Langen | 53/252 X |
| 4,211,054 | 7/1980 | Sramek | 53/502 |
| 4,250,693 | 2/1981 | Andersson | 53/543 |
| 4,509,309 | 4/1985 | Langen et al. | 53/252 X |
| 4,756,139 | 7/1988 | Le Bras | 53/398 |
| 4,936,077 | 6/1990 | Langen et al. | 53/543 |
| 5,036,644 | 8/1991 | Lashyro et al. | 53/398 |
| 5,052,544 | 10/1991 | Anderson | 53/252 X |
| 5,131,523 | 7/1992 | Codde | 53/252 X |
| 5,241,806 | 9/1993 | Ziegler et al. | 53/252 X |

*Primary Examiner*—James F. Coan

*Attorney, Agent, or Firm*—Joel D. Skinner; Steve M. McLary

[57] ABSTRACT

An article group transfer apparatus constructed and arranged to move article groups into open ends of the carton sleeves. The apparatus is incorporated in a continuous motion cartoner assembly for loading article groups into cartons which comprises an article infeed mechanism supplying at least one stream of articles; an article group selection and transport mechanism intersecting the article infeed mechanism to form and transport a longitudinal stream of article groups of a predetermined pattern; a carton supply and transport mechanism synchronized and moving parallel with the article group selecting mechanism to provide cartons with open ends facing the moving article groups; and the article group transfer apparatus which moves the article groups into the open ends of the carton sleeves.

37 Claims, 11 Drawing Sheets

CROSS LOADING APPARATUS FOR USE WITH CARTONING SYSTEMS

This is a continuation-in-part of application Ser. No. 07/856,450, filed Mar. 24, 1992

BACKGROUND OF THE INVENTION

This invention relates to apparatus and methods used in the packaging industry. Particularly, this invention relates to an article group transfer mechanism for use in continuous motion cartoner assemblies which load article groups into cartons or packages. The article group transfer mechanism is a side or cross loading-type device. The apparatus of this invention enables the loading of different types, styles and sizes of articles, such as cans and bottles, and a wide range of article group patterns, both stacked and unstacked, into paperboard or other cartons in a fast and reliable manner.

In the past, various machines and processes have been proposed and utilized to package selected article groups into cartons by loading such article groups from the side or sides of the carton. Each prior art machine and process, however, accomplishes the packaging of the article groups in a distinct manner and utilizes particular structure. Moreover, prior art devices have limited adjustability, limited output capability, and have been difficult to construct and maintain due to their respective designs.

In view of the limitations and shortcomings of prior art methods and apparatus, it is an object of this invention to provide an apparatus which continuously and reliably cartons predetermined product groups at high speed. Another object of this invention is to provide a continuous motion cartoner which is adjustable for use with a variety of cartons, articles and article group types and sizes. A further object of the invention is to provide article group transfer structures which enable an article group to be moved and controlled with a positive force so that the article group may be tightly placed and maintained in a carton. Another object of the invention is to provide article group transfer structures having transversely reciprocating arm assemblies including cam actuated stepped transfer heads for loading product groups in an initially nested configuration having a differentially thinner loading dimension. A further object of this invention is to provide article group transfer structures which are stabilized for high speed operation.

SUMMARY OF THE INVENTION

The present invention provides an article group transfer mechanism constructed and arranged to move article groups into open ends of the carton sleeves. The mechanism is incorporated in a continuous motion cartoner assembly for loading article groups into cartons which comprises an article infeed mechanism supplying at least one stream of articles; an article group selection and transport mechanism intersecting the article infeed mechanism to form and transport a longitudinal stream of article groups of a predetermined pattern; a carton supply and transport mechanism synchronized and moving parallel with the article group selecting mechanism to provide cartons with open ends facing the moving article groups; and the article group transfer mechanism which is constructed and arranged to move the article groups into the open ends of the carton sleeves.

In one embodiment, the lateral transfer apparatus comprises a frame structure; a plurality of transfer elements disposed at predetermined longitudinally spaced intervals, the transfer elements being for laterally moving articles which are being longitudinally transported in at least one stream of the article processing system, each transfer element including a stepped contact member for moveable contact with the article, a support member connected to the contact member, and a control member for directing the lateral movement of the transfer elements, the control member including a first cam follower connected to the support member controlling lateral movement of the transfer elements, and a second cam follower pivotally connected to the support member and further being connected to the contact member via linkage means, the second cam follower providing differential lateral movement to the stepped contact member; means, connected to the support member, to longitudinally move the transfer elements; and a cam track assembly capable of laterally moving the transfer elements, and which is cooperatively mated with the first and second cam followers.

In an alternate embodiment, the lateral transfer apparatus comprises a frame structure; an article group transport stream wherein each article group is disposed on a dead plate and aligned for entry into a package, wherein the dead plate has an elongated, laterally oriented slot of a predetermined width, a plurality of transfer elements disposed at predetermined longitudinally spaced intervals, the transfer elements being for laterally moving article groups which are being longitudinally transported in the article group transport stream; means to longitudinally move the transfer elements; means to laterally move the transfer elements; and a stabilization member disposed on each transfer element for mating insertion into the dead plate slot during lateral extension of the transfer elements.

In a third embodiment, the lateral transfer apparatus is used in an article processing system of the type wherein articles or article groups are transported in one or more longitudinally oriented streams. The apparatus comprises: a frame structure; a plurality of transfer elements disposed at predetermined longitudinally spaced intervals, the transfer elements being for laterally moving articles which are being longitudinally transported in at least one stream of the article processing system, each transfer element including a contact member for contact with the article, a support member connected to the contact member, and a control member for directing the lateral movement of the transfer elements, the control member including at least one cam follower connected to the support member and controlling lateral movement of the transfer elements; means to longitudinally move the transfer elements, the longitudinal movement means being connected to the support member; and a cam track assembly having a predetermined configuration for laterally moving the transfer elements, the cam track assembly being cooperatively mated with at least one cam follower, the cam track configuration providing a constant rate of lateral extension to the transfer elements throughout a majority of a total extension path of each transfer element, the cam track configuration further providing a decreased rate of lateral extension at a predetermined segment of the transfer element extension path for making smooth contact with the article These and other benefits of this invention will become clear from the following description by reference to the drawings.

DESCRIPTION OF THE PREFERRED EMBODIMENT

Figure 1:
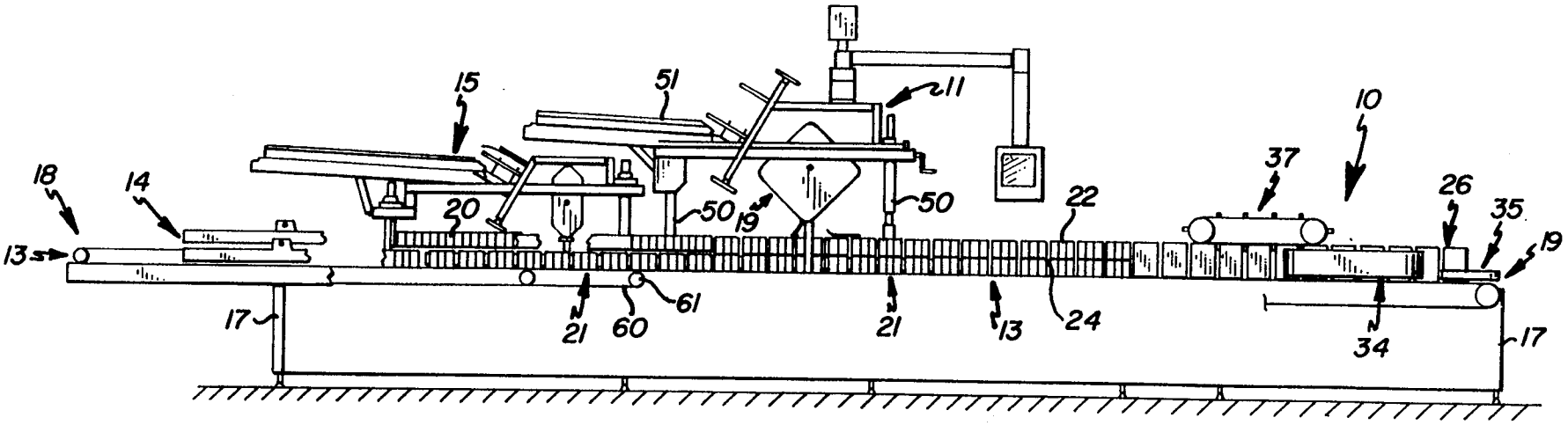
FIG. 1 is a side view of a cartoner assembly incorporating the article group transfer mechanism of the present invention.

The apparatus of the present invention is for loading articles into cartons in a continuous, high speed process. As shown in the drawings, the article group transfer apparatus of this invention is utilized in a continuous, high-speed packaging mechanism 10 to provide reliable, continuous and high speed packaging of articles or products of varying types, sizes and quantities into cartons of varying types and sizes. For example, the apparatus 10 loads standard beverage cans or bottles into 24(12/12), 30(15/15) and 36(18/18) pack stacked combinations and also into common single level 6, 8, 12, 15, 18 and 26 pack configurations utilizing the adjustment features described more fully below. Moreover, the process of loading beverage containers into paperboard carriers, for example, is accomplished quickly and reliably, under typical industry tolerances for both container and carrier construction. The resultant filled carriers output by the apparatus 10 are of uniform consistency having maximized squareness and tautness for improved storage qualities and transportability.

Referring to FIGS. I and 2, the continuous motion cartoner assembly 10 generally comprises a carton supply and transport mechanism or stream 11, an article group selection and transport mechanism or stream 12, a pair of article supply mechanisms or streams 13 and 14, a divider placement mechanism 15, and an article group transfer or cross loading mechanism 16. These mechanisms are shown to be supported by a unitary frame structure 17, although if aligned properly, separate support structures may be utilized consistent with the teachings of this invention.

The carton supply mechanism 11 is shown to be disposed proximate an input end 18 of the assembly 10. Carton sleeves or blanks 25 are subsequently transported in a linear fashion to an output end 21 of the apparatus 10. The article supply mechanisms 13 and 14 are also shown to be disposed at the input end 20 of the apparatus 10. A first portion of each article supply mechanism 13 and 14 is disposed spacially parallel to the article group selection and transport mechanism 12, and a second portion merges, at a predetermined angle, with the article group selection transport mechanism 12 to supply streams of product or articles 20 to two separate positions along the article group selection and transport mechanism 12. These merging mechanisms 12–14 are further constructed and arranged to meter individual articles 20, via a fixed flight bar arrangement, into predetermined article groups 21 and 22 on the mechanism 12.

The stacking function of the device 10 is accomplished by forming a first group 21 at a low level, placing a divider sheet 24 on the lower group 21 via the divider sheet placement mechanism 15, and then simultaneously forming a second group 22 downstream at a higher level and allowing the upper group 22 to slide across the divider sheet 24 by the action of the flight bars of the article group selecting mechanism 12 to form the stacked group 23. The divider placement mechanism 15 preferably comprises a rotary placer mechanism 92 of the type manufactured and sold by Applicants' assignee.

The article group selection and transport mechanism 12 is disposed adjacent and parallel to the carton supply and transport mechanism 11 and extends downstream, in a linear orientation. Merged or combined article groups 23 are transported downstream thereon in a spaced and metered fashion, each group 23 being aligned with a carton 25 traveling on the carton supply and transport mechanism 11.

The cross loading mechanism 16 is disposed adjacent to and parallel with the second portion of the article group selection and transport mechanism 12, extending and traveling longitudinally with respect to the apparatus 10. The cross loading mechanism 16 has a plurality of loading arms which extend transversely or perpendicularly with respect to the transport mechanisms 11, 13 and 14, to move product groups 23 on the article group selection transport mechanism 12 into aligned cartons 25 traveling on the carton transport mechanism 11, thereby loading the cartons 25 with product groups 23.

Still referring also to FIGS. I and 2, the carton supply and transport mechanism 11 is preferably a rotary type carton placer 49, such as that disclosed in U.S. Pat. No. 4,530,686 owned by Applicants' assignee. The carton erecting apparatus 49 is supported above the input end of the carton transport mechanism 11 by a vertically adjustable frame structure 50, and basically transfers flat carton blanks or sleeves 25 from a power magazine 51 to the conveyance surface of the mechanism 11, simultaneously opening the blank 25 so that it assumes a four-sided configuration with opposing open ends bounded by at least one flap 44 each. Importantly, the partially erected carton 25 is placed in a transverse or lateral orientation so that its ends are open to the sides of the carton transport mechanism 11 for loading purposes.

Figure 3:
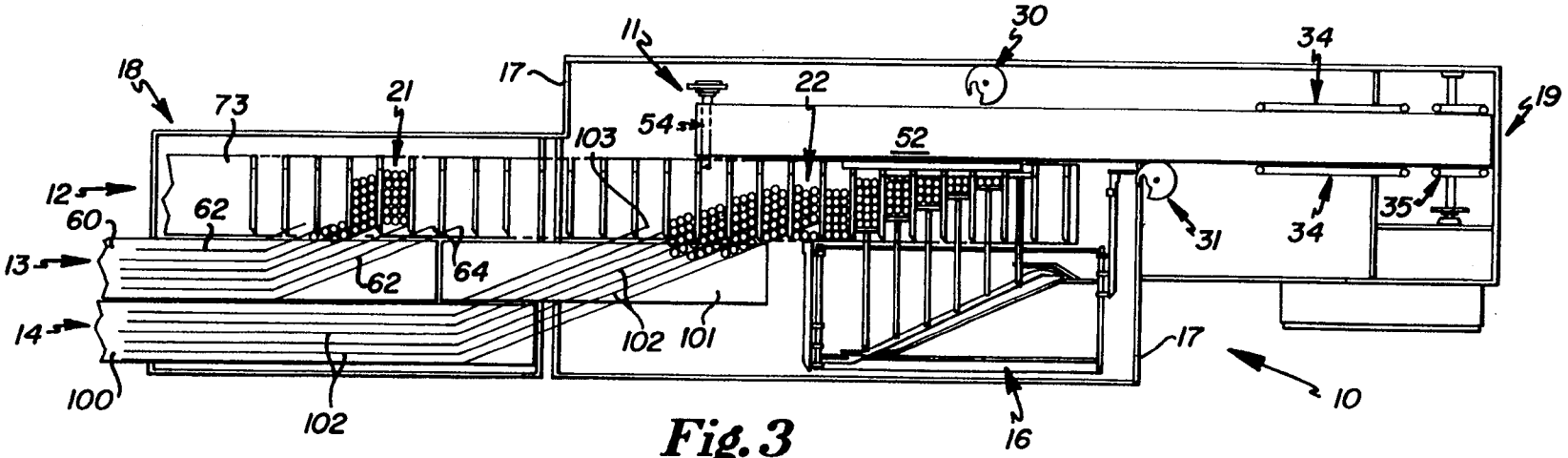
FIG. 3 is a detailed top plan view of the cartoner assembly.
Figure 4:
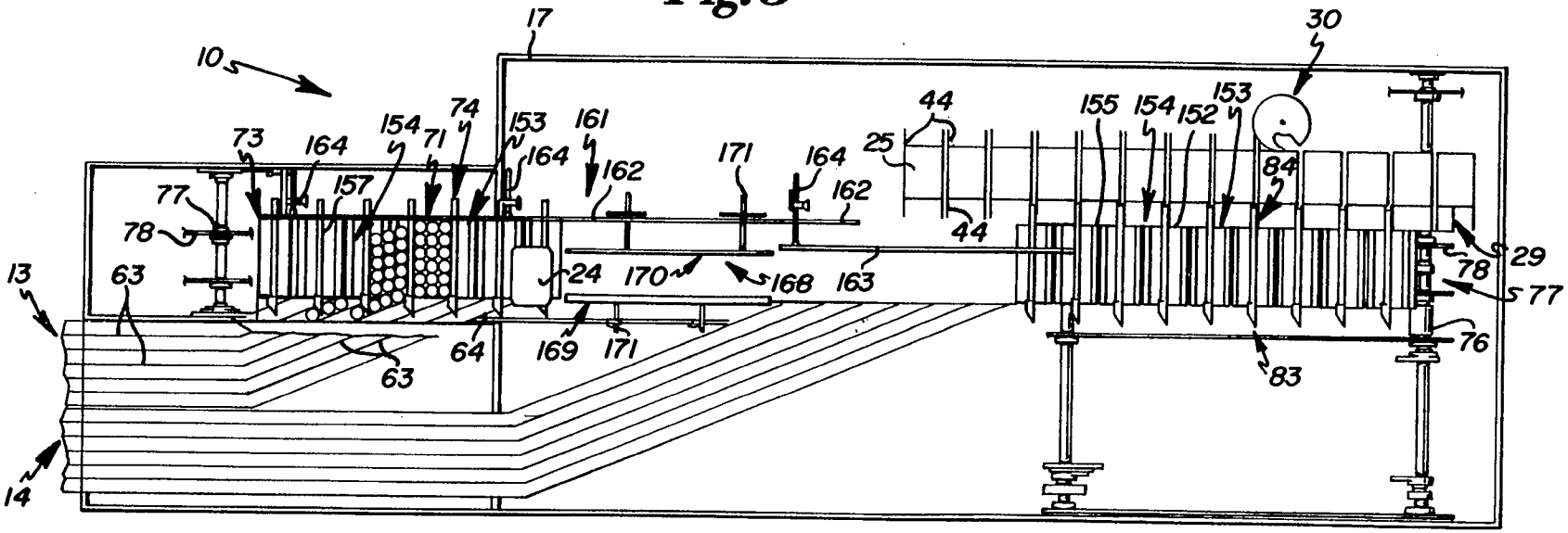
FIG. 4 is a top plan view of a portion of the cartoner assembly.
Figure 6:
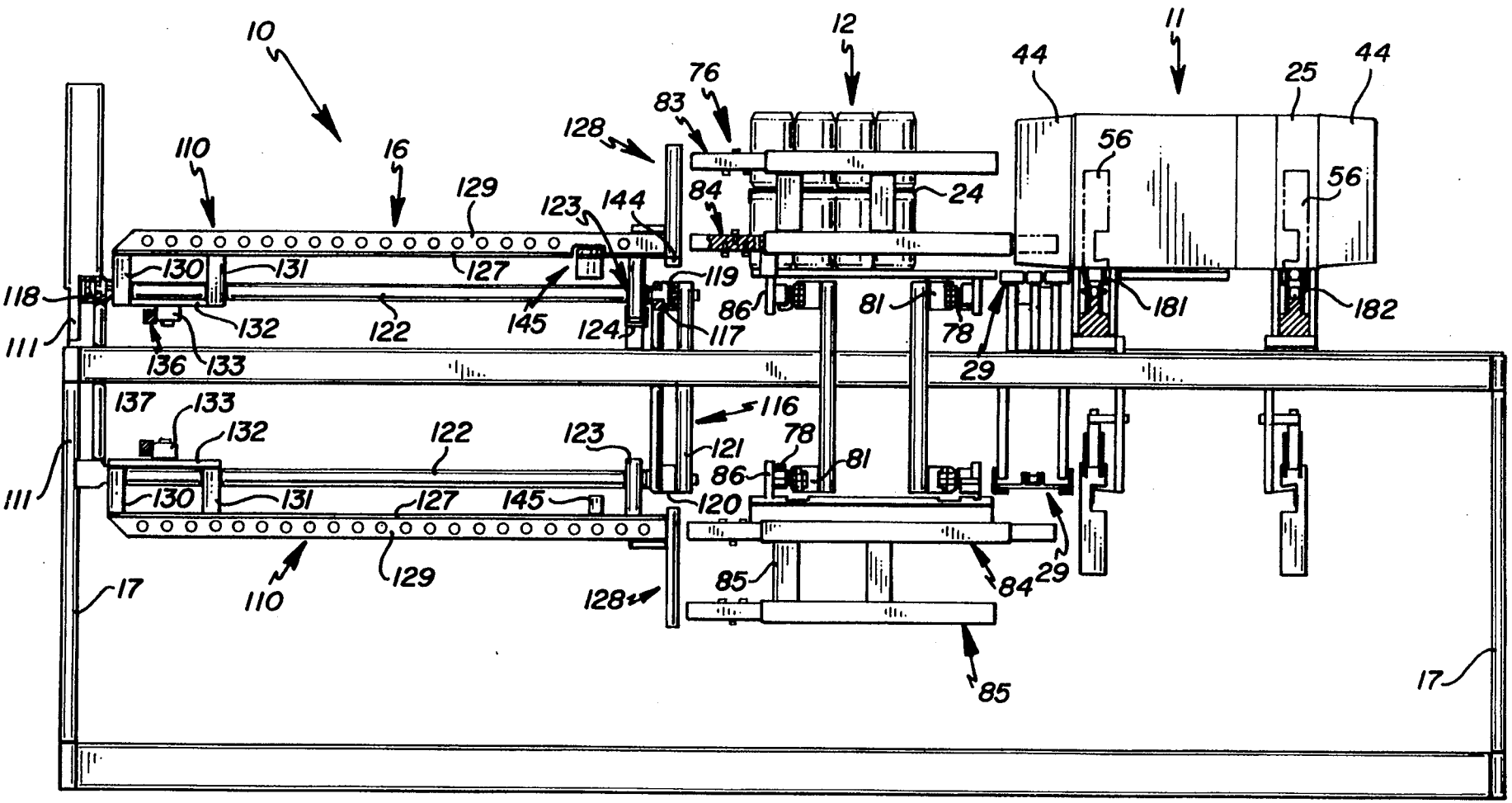
FIG. 6 is a cross-sectional view of the cartoner apparatus taken approximately along line 6—6 of FIG. 2 showing the article group transfer mechanism.
Figure 7:
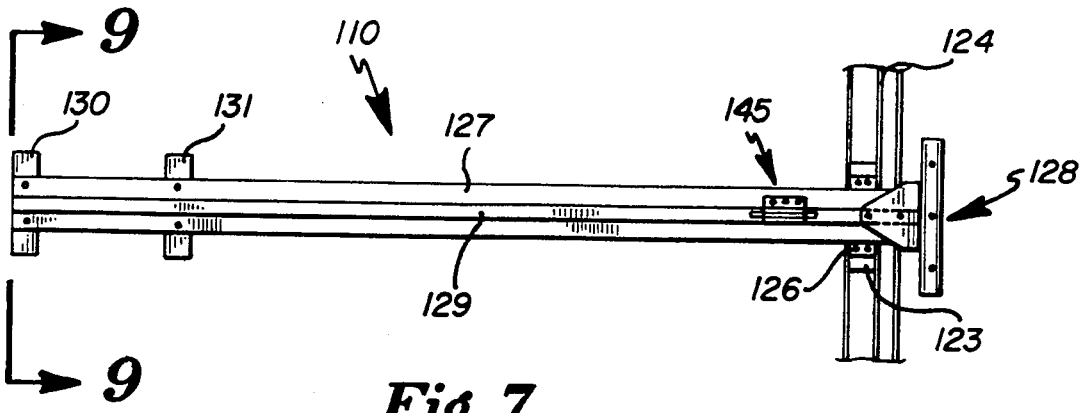
FIG. 7 is a top view of a loader arm assembly.

The carton transport conveyor 52 receives cartons 25 from the carton supply placer 49 and transports them linearly downstream with respect to the overall apparatus 10. The downstream transport of cartons 25 is synchronized with the article group selection and transport mechanism 12 and with the cross loading mechanism 16, as described further below, to effectuate carton 25 loading. The carton transport conveyor 52 is adjustable to accommodate cartons 25 of varying types and sizes. Referring also to FIGS. 3, 4 and 6, the carton transport conveyor 52 basically comprises a plurality of flight lugs 56 which are connected to a pair of flight chains 181 and 182, the flight chains 181 and 182 being connected to and revolving about drive and idler ends 53 and 54. Although a pair of lugs 56 is shown, the number of lugs 56 per carton 25 may be varied for alternative carton configurations. The transverse and longitudinal spacing between lugs 56 on the parallel, side-by-side chains is preferably variable. Adjustment is desirable to permit the apparatus 10 to be used with various carton configurations to allow for adjustment of carton spacing to convert the apparatus 10 from 6 to 36 pack processing for example. The carton supply and transport mechanism 11 may also include a carton stabilization structure (not shown) to support the tops of the relatively tall, bi-level cartons 25 traveling on the mechanism 11, particularly during the loading phase of operation.

Referring to FIGS. 1–4, the first or low article supply mechanism 13 provides a plurality of input individual articles 20 to the apparatus 10 at a first predetermined level or height and at a predetermined point on the article group selection and transport mechanism 12. The mechanism 13 is shown to comprise a conveyor 60 disposed about a drive sprocket/shaft assembly 61 and an idler sprocket/shaft assembly 62. The conveyor 60 preferably consists of a unitary, belt. Articles 20 transported on the top, forward run of the conveyor 60 are separated into a plurality of single file paths by lane separators 63. Each lane separator 63 has a terminal portion 64 of a predetermined length, such that it extends into the path of the article group selection and transport mechanism 12. Each terminal portion 64 is constructed such that it allows longitudinally transported flight structures 74 (described further below) of the article group selection and transport mechanism 12 to pass through the angled conveyance lanes. As the flight bars 74 mesh with and pass through the lane separator end portions 64, they engage articles 20 disposed in lanes and rake them onto the longitudinal conveyance path of the mechanism 12 and between adjacent flight bars 74.

The combination of forces exerted by the flight bars 74, lane ends 64, and conveyors 60 and 12 serve to select and meter individual articles 20 into predetermined article groups 21 which are fully merged onto the article group selection and transport mechanism 12. The size, orientation and dimensions of the resultant product groups 21 is dependent upon the number of infeed lanes, product dimensions, and the configuration and spacing of the flight bars 74. Lanes may be blocked off by closure means 67 to alter the group 21 size and/or orientation. The lane separators 63 and the flight bars 74 are adjustable to provide full variability of product group parameters.

The article group selection and transport mechanism 12 selects article groups 21 and 22 from the first or low article supply mechanism 13 as set forth above and from the second or high article supply mechanism 19 discussed below, and transports them linearly downstream with respect to the overall apparatus 10. The downstream transport of article groups 21 and 22 is synchronized with the carton supply and transport mechanism 11 and with the cross loading mechanism 16, as described further below, to effectuate carton 25 loading. The article group selection and transport mechanism 12 comprises a conveyor 73, a plurality of flight bar assemblies 74 fixed to and longitudinally transported on the conveyor 73, and a plurality of slide plates 75, which are disposed on the conveyor 73 between the spaced flight bars 74. The conveyor 73 includes a drive sprocket/shaft assembly 76 and an idler sprocket/shaft assembly 77, a pair of parallel endless conveyor chains 78 which are connected to and revolve about the sprocket/shaft assemblies 76 and 77, forming a longitudinally extending forward or top run 79 and a return or bottom run 80.

Referring also to FIGS. 4 and 6, the flight bar assemblies 74 are each shown to include a top rail member 83 and a bottom rail member 84 which are connected to one another by vertical spacers 85. The top and bottom members 83 and 84 are shown disposed parallel to one another and spacially separated by the spacers 85. Each top and bottom member 83 and 84 further has an angled front end 150 and an elongated, rectilinear body 151 terminating in a flat back end. The front end 150 slants or angles inwardly from its leading edge to its trailing edge to enable the flight bars 74 to select individual articles 20 disposed in the article infeed lanes and to separate them from the closely spaced nearest upstream article 20. As is best shown in FIG. 4, a pair of fixed slide plates 152 and 153 are connected to each flight bar 74 assembly. Both the flight bars 74 and the slide plates 152 and 153 are connected to the flight chains 78 via connection brackets 86. The slide plates 152 and 153 are thin, flat structures with a low friction top surface which support the lower article groups 21 and further permit sliding movement thereon. Additionally, slotted slide plates 154 are disposed between adjacent flight bar assemblies 74. Importantly, each plate 154 includes a laterally oriented slot 155 of a predetermined width which extends the length of the plate 154 and is open at both of its ends. This slot 155 cooperates with portions of the cross loading assembly 16 to stabilize the assembly 16 during high speed operation and also enables the construction of a more compact assembly.

Referring again to FIGS. 1 and 2, the second or high article supply mechanism 14 provides a plurality of input individual articles 20 to the apparatus 10 at a second predetermined level or height and at a predetermined point downstream from the low article supply mechanism 13. The mechanism 14 is also shown to comprise a pair of conveyors 100 and 101, each being disposed about a drive sprocket/shaft assembly and an idler sprocket/shaft assembly. Articles 20 transported on the top, forward run of the conveyors 100 and 101 are separated into a plurality of single file paths by lane separators 102. Each lane separator 102 has a terminal portion 103 of a predetermined length, such that it extends into the path of the article group selection and transport mechanism 12 a predetermined distance. Each terminal portion 103 is constructed such that it allows the longitudinally transported flight structures 74 of the article group selection and transport mechanism 12 to pass through the angled conveyance lanes. As the flight structures 74 mesh with and pass through the lane separator end portions 103, they engage articles 20 disposed in lanes and rake them onto the longitudinal conveyance path of the mechanism 12.

The article group lateral transfer or cross loading mechanism 16 is synchronized with the aforementioned apparatus 10 elements to move completed, stacked article groups 23 traveling on the article group selection and transport conveyor 12 into aligned cartons 25 traveling on the carton supply and transport conveyor 11. Referring to FIGS. 3–11, the cross loading mechanism 16 basically comprises a plurality of loader arm assemblies 110, a flight chain and guide tube assembly 111 to which the loader arm assemblies 110 are attached at predetermined intervals, and which provides a longitudinal movement component thereto, and a control cam assembly 112 which provides a predetermined transverse motion component to the loader arm assemblies 110.

The flight chain and guide tube assembly 110 has a forward or top run 113 and a return or bottom run 114 and comprises drive and idler sprocket/shaft assemblies 115 and 116 and a pair of spacially parallel flight chains 117 and 118 which are connected to and revolve about the sprocket/shaft assemblies 115 and 116. The flight chains 117 and 118 are maintained in a rectilinear configuration on both the top and bottom runs 113 and 114 by chain guides 119 and 120, which are linked to the frame 17 via vertical support members 121.

Figure 10:
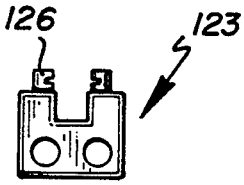
FIG. 10 is an end view of a loader arm guide.

Pairs of elongated guide tubes 122 are disposed at predetermined intervals along the flight chains 117 and 118, each guide tube 122 being directly connected at one end to the outer flight chain 118, and at its opposite end to the inner flight chain 117 so that they are oriented transversely with respect to the axis of the apparatus 10 and to the downstream or forward run of the cross loader 16. The guide tubes 122 have a low friction exterior surface to provide slidable support of the loader arm assemblies 110. The pairs of closely spaced tubes 122 increase the stability of transverse movement of the arm assemblies 110. Further stability is attained by the guide blocks 123 (connected to the inner ends of the guide tubes 122 via set screws) traveling in a longitudinally oriented guide rail 124 which is linked to the frame 17 via a support 125. As best shown in FIG. 10, lateral retainers 126 are mounted on the top of each guide block 123 to guide the transversely moving arm assemblies 110. The spacing between successive sets (pairs) of tubes 122 corresponds to the spacing between the flight bars 74 of the article group selection and transport conveyor 12 and of the flight lugs 56 of the carton transport conveyor 11 so that the arm assemblies 110 are aligned to push product groups 23 from between the flight bars 74 into the cartons 25.

The loader arm assemblies 110 are movably mounted on the guide tubes 122, and in a transverse orientation with respect to the axis of the apparatus 10. The arm assemblies 110 are conveyed in a downstream, longitudinal direction while they simultaneously reciprocate in a transverse direction under the control of a cam mechanism 112 described below. Each loader arm assembly 110 basically comprises an elongated, rectilinear base plate 127 and a loading head 128 located at one end of the base plate 127. The base plate 127 is shown to have a rigid, flat, elongated structure which is oriented horizontally. A rigid stiffing bar 129 is connected to the top surface of the base plate 127, vertically oriented, to increase the rigidity and strength of the arm assembly 110. Preferably, a plurality of bores are disposed in the stiffing bar 129 to reduce its weight. The inwardly disposed end of the base plate 127 is slidably supported by the lateral retainers 126 of the guide block 123. A first or outer bushing block 130 is connected to the bottom of the base plate 127 at its opposite end. The first bushing block 130 has a pair of apertures, including bushings, through which the guide tubes 122 are slidably extended. A second or inner bushing block 131 is similarly connected to the base plate 127 and interfaces with the guide tubes 122 a short distance from the first bushing block 130. The bushing blocks 130 and 131 are further connected by a spreader bar 132 which is oriented and rides in the space between the guide tubes 122. A rotatable cam follower 133 is connected to the bottom of the spreader bar 132. The longitudinally traveling cam follower 133 cooperates with the cam guide assembly 112 to cause the arm assembly 110 elements to transversely reciprocate on the guide tubes 122 and through the lateral retainers 126 of the guide block 123.

Figure 5:
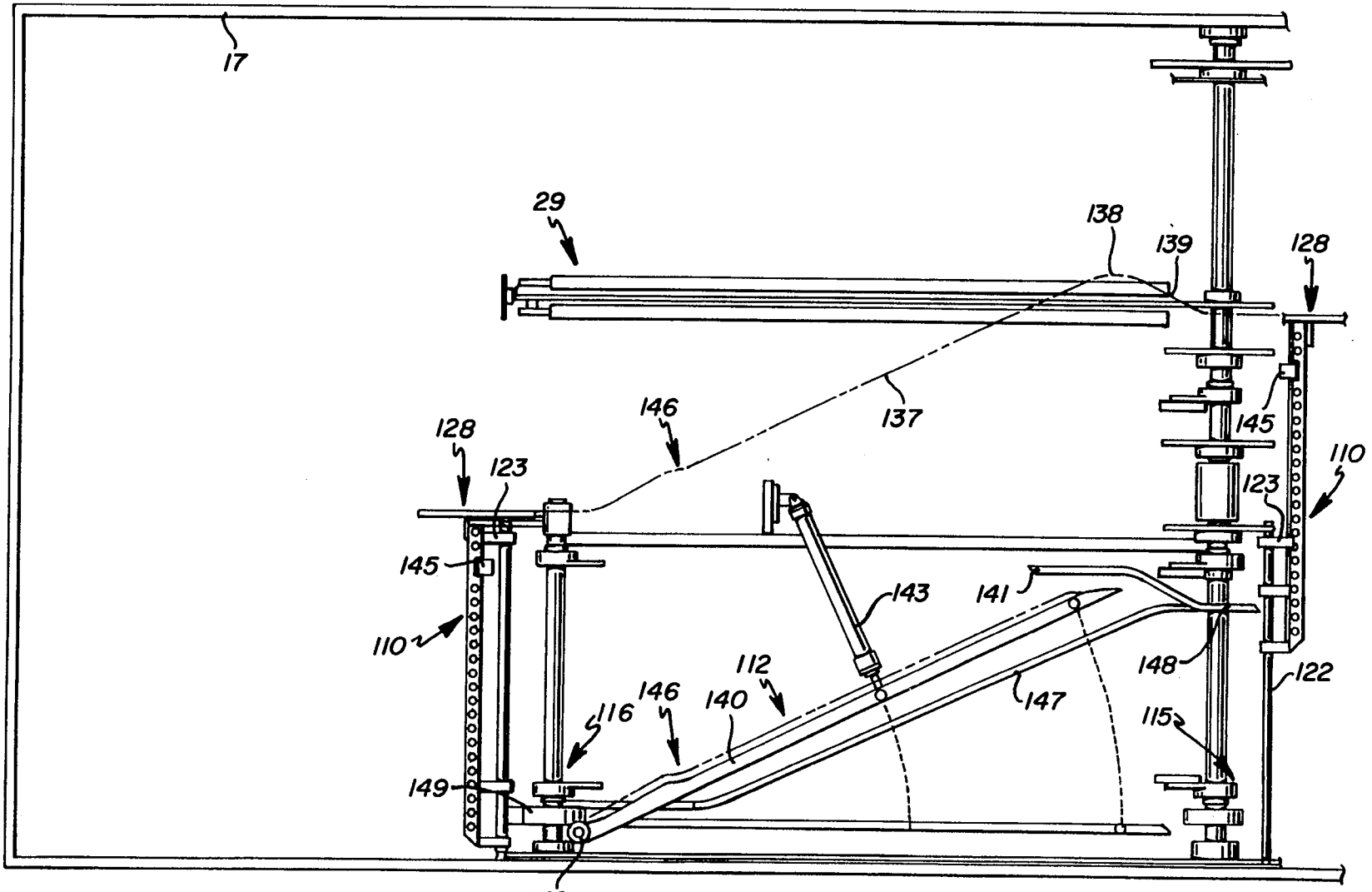
FIG. 5 is a top view of a portion of the cross loading mechanism.

The loading head 128 is shown to have two fixed, flat face members 134 and 135. As the arm assemblies 110 move forward, the face members 134 and 135 push the article groups forward from the article group selection transport conveyor 12 into the cartons 25. A support roller 144 is disposed on the bottom of the head 128 to provide support when the head 128 is extended across the article group selection and transport mechanism 12. Additionally, a T-shaped guide pin 145 is disposed on the bottom of the base plate 127 of the arm assembly 110 to mate with the slot 155 in slide plate 154 to laterally stabilize the arm member 110 during high speed operation. As is shown in FIG. 5, at the downstream end of the cross loading assembly 16, the loading arm 110 is substantially laterally extended at the point where it is revolving around the drive shaft assembly 115 to enter the bottom downstream run. In this region, shifting or destabilizing forces are exerted on the extended arms 110 during high speed operation. The cooperation of the guide pin 145 in the slide plate 154 slot 155 serves to stabilize the arm 110, and to prevent deleterious shifting. And as a result, the overall length of the cross loading assembly 16 is reduced as the lateral position of the arms 110 are retracted or reset along the bottom run, as opposed to being reset on the top run as in the alternative embodiment described below.

The loading head 128 configuration is variable to interface with a wide range of product group 23 configurations. Although in the instant embodiment the head 128 is configured for use with a stacked configuration, the head 128 can be modified for cartoning various other product and product group arrangements, including non-stacked configurations. Head 128 modification is accomplished by changes in the configuration of the face members 134 and 135. A transition conveyor 29, shown in FIGS. 5 and 6, is disposed between the cross loading mechanism 16 and the carton transport mechanism 12 to provide a moving base for the movement of the article groups 23 into the longitudinally conveyed cartons 25. A fixed dead plate may alternatively be used. The bottom member 84 of the flight bars 74 is elongated to extend across the top run of the transition conveyor 29 to guide or funnel article groups 23 across the conveyor 29 and into the cartons 25, between the carton end panels 44.

The loader control cam assembly 112 controls the transverse, reciprocal motion of the arm assemblies 110. The loader control cam assembly 112 is generally oriented longitudinally with respect to the overall cross loading mechanism 16, and has a top or forward run 136 and a bottom or return run 137 corresponding to the revolving arm assemblies 110. The top run 136 basically comprises an inwardly sloping approach segment 137, an apex 138, and an outwardly sloping return segment 139. In the approach segment 137, the cam follower 133 is urged inwardly, and drives each arm assembly 110 into moving engagement with a product group 23 until it is loaded in a carton 25. A lag segment 146 of decreased slope is disposed at a predetermined point where the loading head 128 first contacts the article group 23 to provide gentle, even pressure at this initial contact point. In the return segment 139, the face 128 is retracted from the carton 25 prior to its being reset in the return run 137 of the cam assembly 112. The forward run 136 of the cam assembly 112 comprises an outer rail 140 and an inner rail 141 which is spaced from the inner rail 140 a distance equivalent to the diameter of the cam follower 133. The follower 133 is disposed in a cam pathway formed between the outer and inner rails 140 and 141 to effectuate transverse, inward motion to the arm assemblies 110. Preferably, the outer rail 140 is connected to a pivot point 142 at one end and to a release mechanism, such as a pressure release cylinder and piston 143 proximate its opposite end. The release mechanism 143 is controlled by a sensing mechanism, for example, a photoeye or capacitive proximity sensor, such that if an excessive force is placed on the outer rail 140, for example due to a jamming of the arm assembly 110, the release mechanism 143 will be actuated releasing the outer rail 140 which pivots about point 142.

The bottom or return run 136 of the cam assembly 112 includes circular guide plates 148 and 149, and a bottom cam rail 147 which contacts the cam follower 133 to further retract and reset the loader arms 110 for further loading cycles. Since the loader arms 110 are substantially extended when they revolve around sprocket/shaft assembly 115, it is critical that they be stabilized by the guide pin 145 in slide plate 154 groove 155 during high speed operation.

Figure 2:
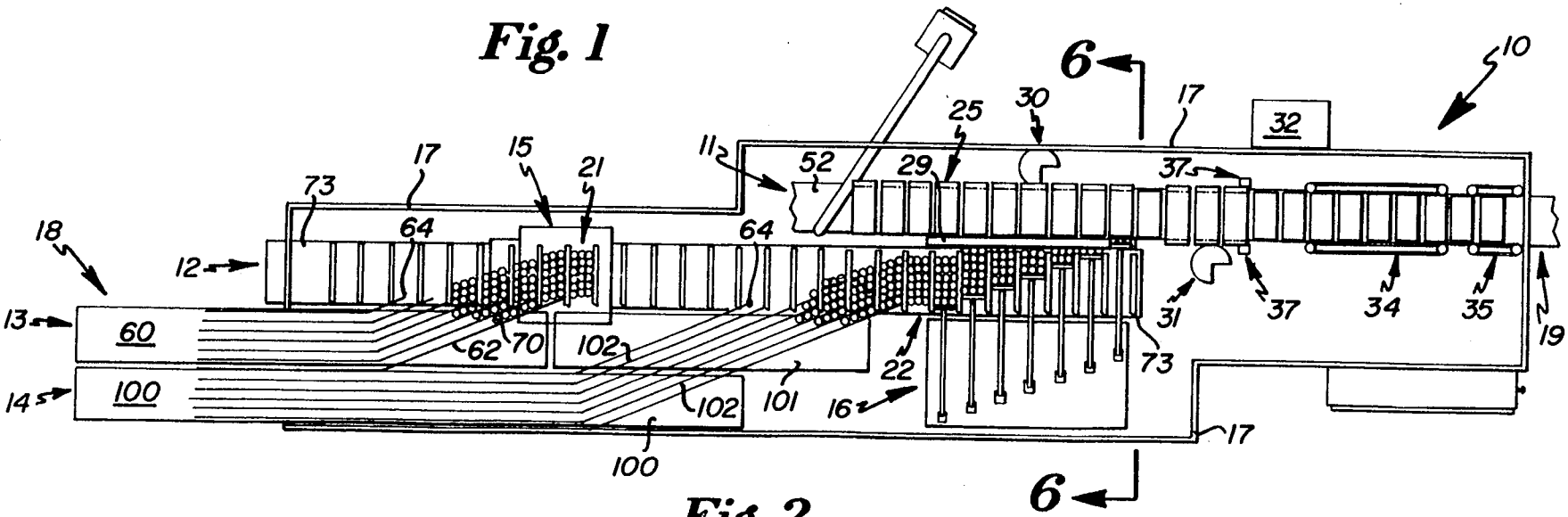
FIG. 2 is a top plan view of the cartoner assembly.

As shown in FIGS. 2, 3, and 4, lateral and medial flap tuckers 30 and 31 are disposed adjacent each side of the carton transport mechanism 11, one anterior to the loading region to provide a closed carton backside against which the loaded containers may nest, and one posterior to the loading region to allow article group 23 ingress to the carton 25 through its open, unglued end flaps 44. As shown in FIGS. 1 and 3, gluing, compression and discharge mechanisms 32, 33, 34, 35 and 37 are disposed further downstream and adjacent the carton supply and transport mechanism 11 to complete the carton flap securement process.

Referring to FIGS. 12–21, an alternate transfer or cross loading mechanism embodiment 183 is shown incorporated with related cartoning apparatus 184 elements to move single level, non-stacked article groups 185 traveling on an article group transport conveyor 186 into aligned cartons 187 traveling on a carton transport conveyor 188.

Figure 12:
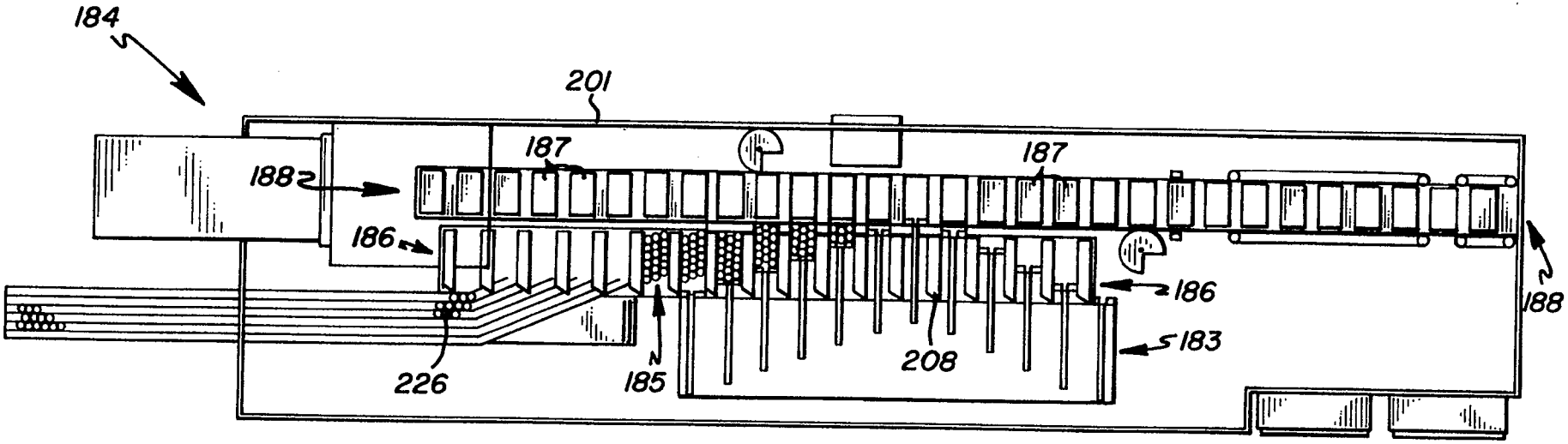
FIG. 12 is a top plan view of another continuous motion cartoner assembly utilizing an alternative embodiment of the article group transfer mechanism of the present invention.
Figure 13:
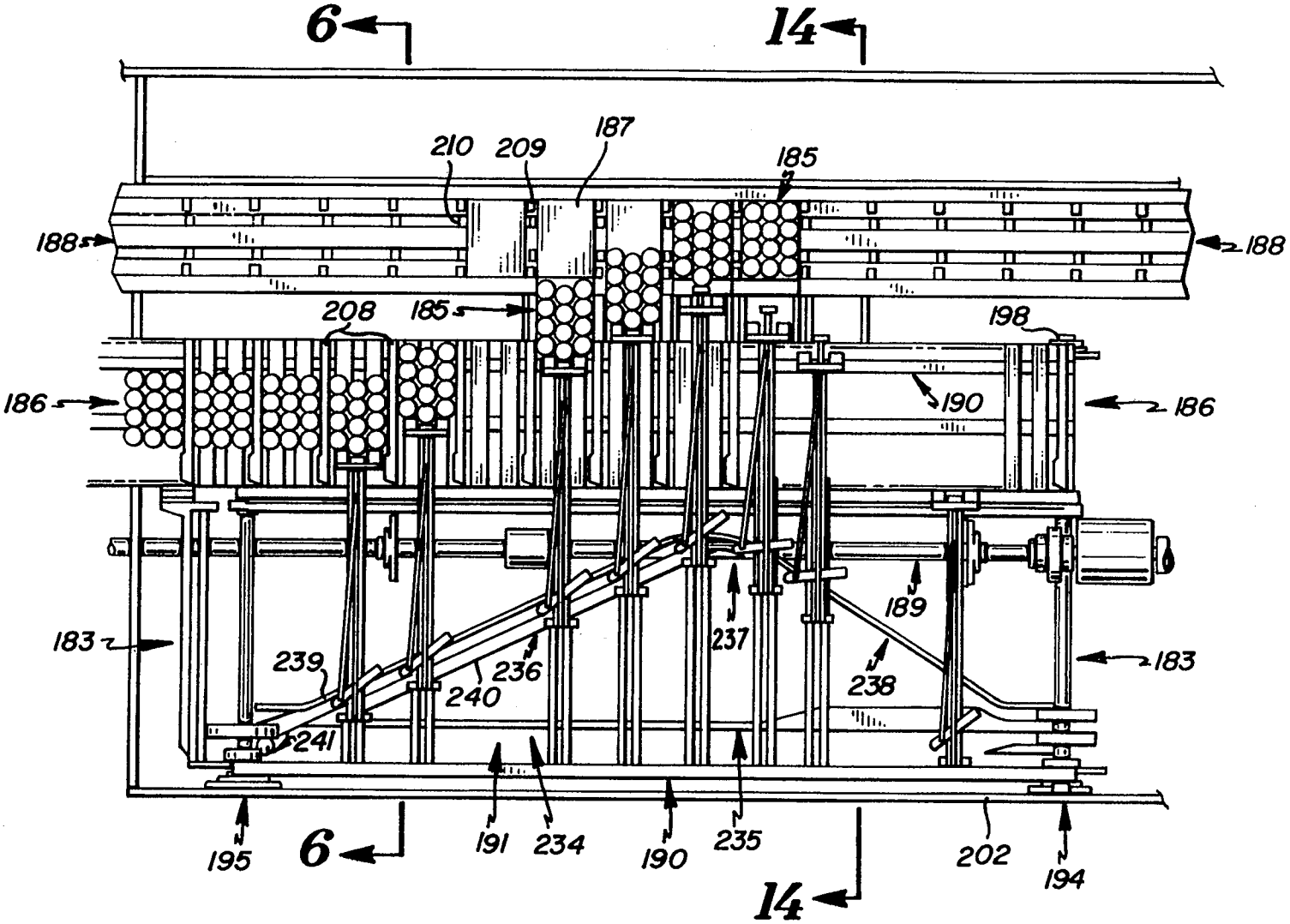
FIG. 13 is a detailed top view of the article group transfer mechanism.
Figure 14:
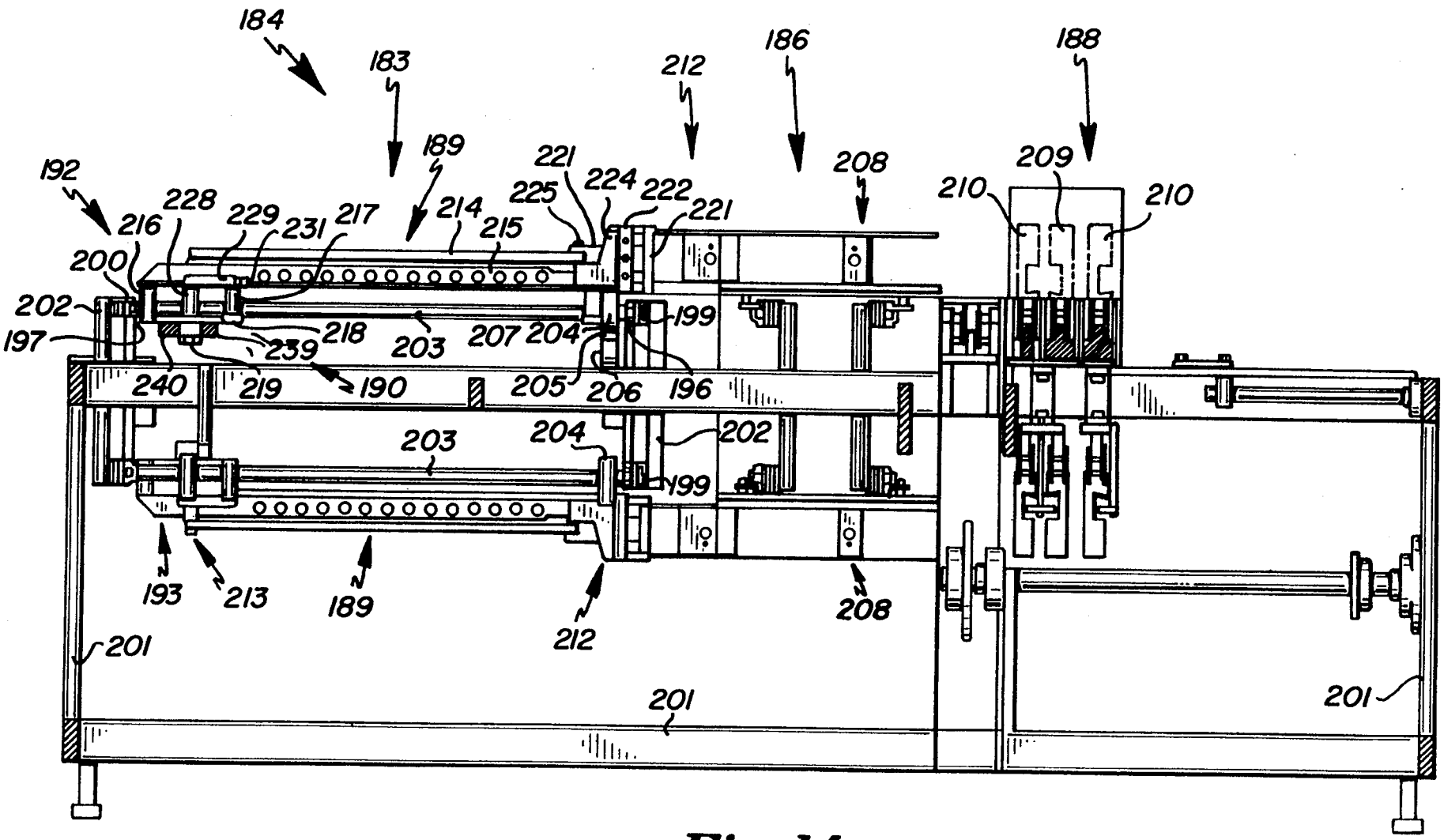
FIG. 14 is a cross-sectional view of the cartoner assembly taken approximately along line 14—14 of FIG. 3.
Figure 15:
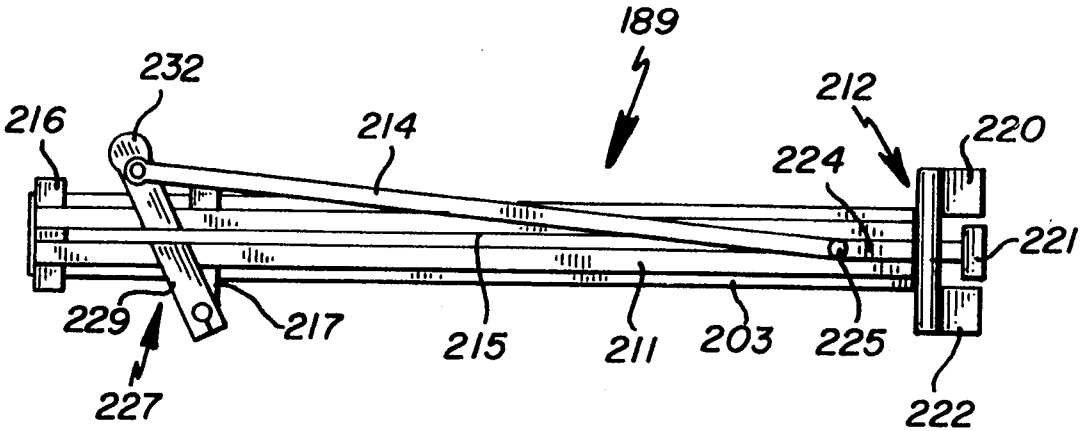
FIG. 15 is a top view of the loader arm assembly.
Figure 16:
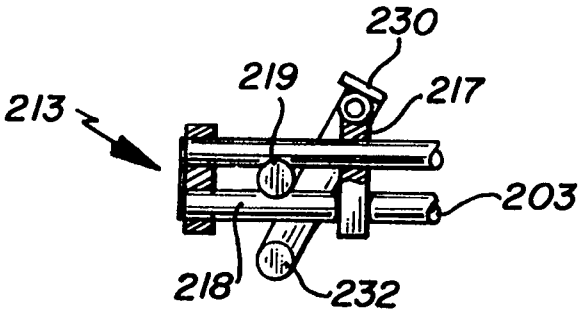
FIG. 16 is a bottom view of an end portion of the loader arm assembly partially in cross-section.
Figure 17:
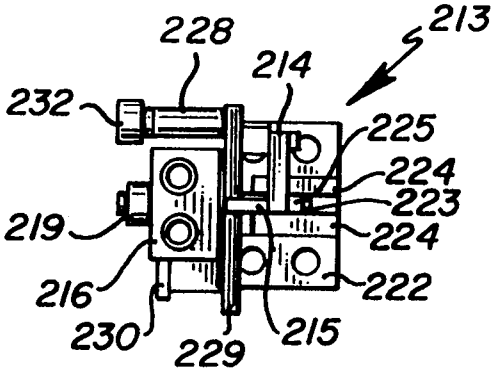
FIG. 17 is an end view of the loader arm assembly, taken from the left side of FIG. 15.
Figure 18:
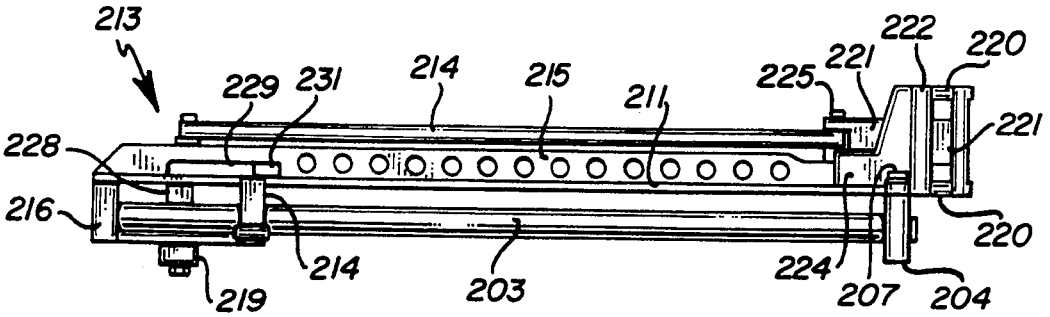
FIG. 18 is a side view of the loader arm assembly.
Figure 19:
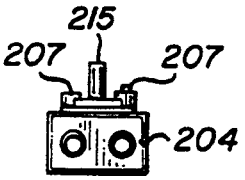
FIG. 19 is an end view of the loader arm assembly of FIG. 18, taken from the left side of the loader arm assembly.

Referring to FIGS. 12, 13 and 14, the cross loading mechanism 183 basically comprises a plurality of loader arm assemblies 189, a flight chain and guide tube assembly 190 to which the loader arm assemblies 189 are attached at predetermined intervals, and which provides a longitudinal movement component thereto, and a control cam assembly 90 which provides a predetermined transverse motion component to the loader arm assemblies 189.

The flight chain and guide tube assembly 190 has a forward or top run 192 and a return or bottom run 193 and comprises drive and idler sprocket/shaft assemblies 194 and 195 and a pair of spacially parallel flight chains 196 and 197 which are connected to and revolve about the sprocket/shaft assemblies 194 and 195. The idler sprocket/shaft assembly 195 is disposed adjacent and immediately posterior to the region of the article transport conveyor 186 where the product groups 185 have been fully merged therein, and marks the beginning of the flight chain assembly 190. The drive sprocket/shaft assembly 194 is disposed downstream and adjacent to the article transport conveyor drive assembly 198, and marks the end of the cross loader 183. The flight chains 196 and 197 are driven by the sprocket/shaft assembly 194. The flight chains 196 and 197 are maintained in a rectilinear configuration on both the top and bottom runs 192 and 193 by chain guides 199 and 200, which are linked to the frame 201 via vertical support members 202.

Pairs of elongated tubes 203 are disposed at predetermined intervals along the flight chains 196 and 197, each guide tube 203 being directly connected at one end to the outer flight chain 197, and at its opposite end to the inner flight chain 196 so that they are oriented transversely with respect to the axis of the apparatus 184 and to the downstream or forward run of the cross loader 183. The guide tubes 203 have a low friction exterior surface to provide slidable support of the loader arm assemblies 189. The pairs of closely spaced tubes 203 increase the stability of transverse movement of the arm assemblies 189. Further stability is attained by the guide blocks 204 (connected to the inner ends of the guide tubes 203 via set screws) traveling in a longitudinally oriented guide rail 205 which is linked to the frame 201 via a support 206. Lateral retainers 207 are mounted on the top of each guide block 204 to guide the transversely moving arm assemblies 189. The spacing between successive sets (pairs) of tubes 203 corresponds to the spacing between the flight bars 208 of the article transport conveyor 186 and of the flight lugs 209 and 210 of the carton transport conveyor 188 so that the arm assemblies 189 are aligned to push product groups 185 from between the flight bars 208 into the cartons 187.

The loader arm assemblies 189 are movably mounted on the guide tubes 203, and in a transverse orientation with respect to the axis of the apparatus 184. The arm assemblies 189 are conveyed in a downstream, longitudinal direction by the cross loader 183, while they simultaneously reciprocate in a transverse direction under the control of a cam mechanism 90 described below. Referring to FIGS. 14–19, each loader arm assembly 189 basically comprises an elongated, rectilinear base plate 211, a stepped loading head 212 located at one end of the base plate 211, pivotal means 233 to actuate the stepped head 212 located generally at the opposite end of the base plate 211, and an elongated connection bar 121 which connects the actuation means 233 to the stepped head 212.

The base plate 211 is shown to have a rigid, flat, elongated plate like structure which is oriented horizontally. A rigid stiffing bar 215 is connected to the top surface of the base plate 211, vertically oriented, to increase the rigidity and strength of the arm assembly 189. Preferably, a plurality of bores are disposed in the stiffing bar 215 to reduce the weight of the bar 215, while maintaining its strength. The inwardly disposed end of the base plate 211 is slidably supported by the lateral retainers 207 of the guide block 204 of the flight chain and guide tube assembly 190. A first or outer bushing block 216 is connected to the bottom of the base plate 211 at its actuation end 233. The first bushing block 216 has a pair of apertures, including bushings, through which the guide tubes 203 are slidably extended. A second or inner bushing block 217 is similarly connected to the base plate 211 and interfaces with the guide tubes 203 a short distance from the first bushing block 216. The bushing blocks 216 and 217 are further connected by a spreader bar 218 which is oriented and rides between the guide tubes 203. A rotatable cam follower 219 is connected to the bottom of the spreader bar 218. The longitudinally traveling cam follower 219 cooperates with the cam assembly 90 to cause the above discussed arm assembly 189 elements to transversely reciprocate on the guide tubes 203 and through the lateral retainers 207 of the guide block 204.

The loading head 212 has one or more fixed face members 220 and one or more extensible face members 221. The fixed face members 220 are connected to a backing plate 222. The extensible member 221 has a rear or tail portion which extends through an aperture 223 in the backing plate 222 and is laterally supported by vertical supports 224. The tail portion is pivotally connected to the connecting bar 121 via a connection rod 225. Referring also to FIG. 3, each face member 220 and 221 contacts an individual container or article 226 located and exposed for contact at one end of the article group 185. Since the articles are arranged in rows, as the arm assemblies 189 move forward, the face members 220 and 221 push the rows of articles forward from the article transport conveyor 186 into the cartons 187. Additionally, the face members 220 and 221 are shown to be stepped or staggered so that the adjacent rows of articles 226 are also staggered or unaligned. In this configuration, the cylindrical containers in adjacent rows rest closer to one another than they would when aligned. Hence, the width of the nested product groups 185 is less than that of the aligned groups 185. This decreased product group 185 width is exploited during carton loading to improve product group ingress reliability and speed. Subsequent to loading, this nested product group configuration is altered, as described below, to provide a taut, fully loaded, square carton 187 with minimum wasted space. The differential product group configuration provided by the stepped, actuatable loading head 212 is particularly beneficial given normal carton and beverage container manufacturing tolerances. Also, taut, fully loaded, square cartons are more stable for improved storage and handling, with less article shifting and breakage. This is especially desirable in glass beverage containers.

Still referring to FIG. 13, at the apex position of approach of each arm assembly 189, the extensible face member 221 is shown to move from a retracted position with respect to the fixed face members 220 to an extended position, wherein it is nearly flush with the fixed face members 220. This occurs at the point the product groups 185 are fully inserted into the carton 187. It is this extension which aligns the product group rows with one another, resulting in a normal product group 185. The extensible face member 221 is controlled by the cam assembly 90, via the actuation end 233 and connection bar 121. The cam assembly 90 simultaneously controls the transverse reciprocation of the entire arm assembly 189.

Figure 8A:
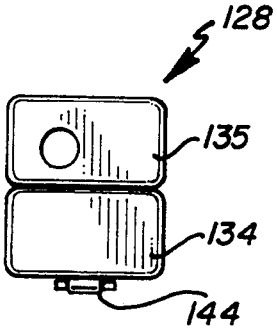
FIGS. 8*a* and 8*b* are side and end views of a pushing face.
Figure 8B:
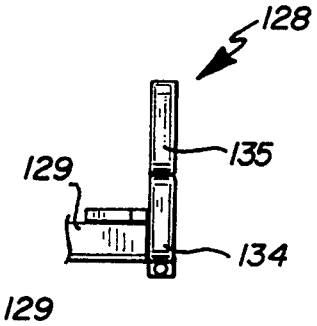
Figure 11:
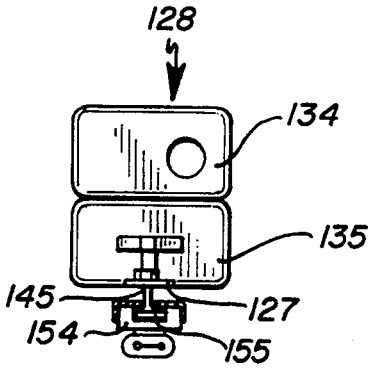
FIG. 11 is an end view of a portion of a loader arm assembly operatively extended across the article group selection and transport mechanism.
Figure 9:
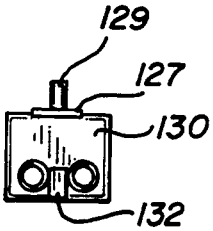
FIG. 9 is an end view of the loader arm assembly taken along line 9—9 of FIG. 7.

A pivot arm 228 is disposed at the actuation end 233 of the arm assembly 189. Importantly, the pivot arm 228 cooperates with the cam assembly 90 to actuate (via the connecting bar 121) the loading head 212. The pivot arm 228 has a cylindrical vertical member 228 and a bar-shaped horizontal member 229 connected at a first end to the top of the vertical member 228 and oriented at a right angle thereto. The horizontal member 229 is pivotally connected at its opposite or second end to the second bushing block 217, via a pivot point 230. The connecting bar 121 is pivotally connected to the top of the horizontal member 229, proximate the first end thereof. As best shown in FIG. 8, the horizontal members 229 extends and is movable through a slotted aperture 231 (shown in FIG. 9) in the base plate stiffener 215. A rotatable cam follower 232 is disposed at the bottom end of the vertical member 228. The longitudinally moving cam follower 232 cooperates with the cam assembly 90 to cause the pivot arm 228 to pivot about point 230 and to thereby move connection bar 121 relative to the longitudinal axis of the arm assembly 189. This in turn actuates the extensible face member 221 of the loading head 212.

The loading head 212 configuration is variable to interface with a wide range of product group 185 configurations. Although in the instant embodiment the head 212 is configured for use with a 3 by 4 12—pack configuration, the head 212 can be modified for cartoning 2 by 6 12—packs, 6 packs, 24 packs and various other product group arrangements, including stacked configurations. The essential feature of the head 212 is that the face members contacting the end containers alternate between fixed-type members 220 and extensible-type members 221 so that the container rows may be initially staggered for loading purposes. Head 212 modification is accomplished by changes in the configuration of the face members and their placement on the backing plate 222. The head 212 configuration may also be adjusted to accommodate various container sizes, types and configurations. Additionally, the loading head 212 may be bifurcated, as shown in FIG. 2, to further divide pregrouped patterns selected by the flights 208 in cooperation with a wedge shaped dividing funnel assembly 233. Utilizing this head 212 configuration the apparatus 184 has the ability to achieve cartoning rates approximately twice that of conventional systems. Modifications may be made to the remaining elements of the cross loader 183 to provide cam-actuated stepped faces in this twin-headed embodiment.

Figure 20:
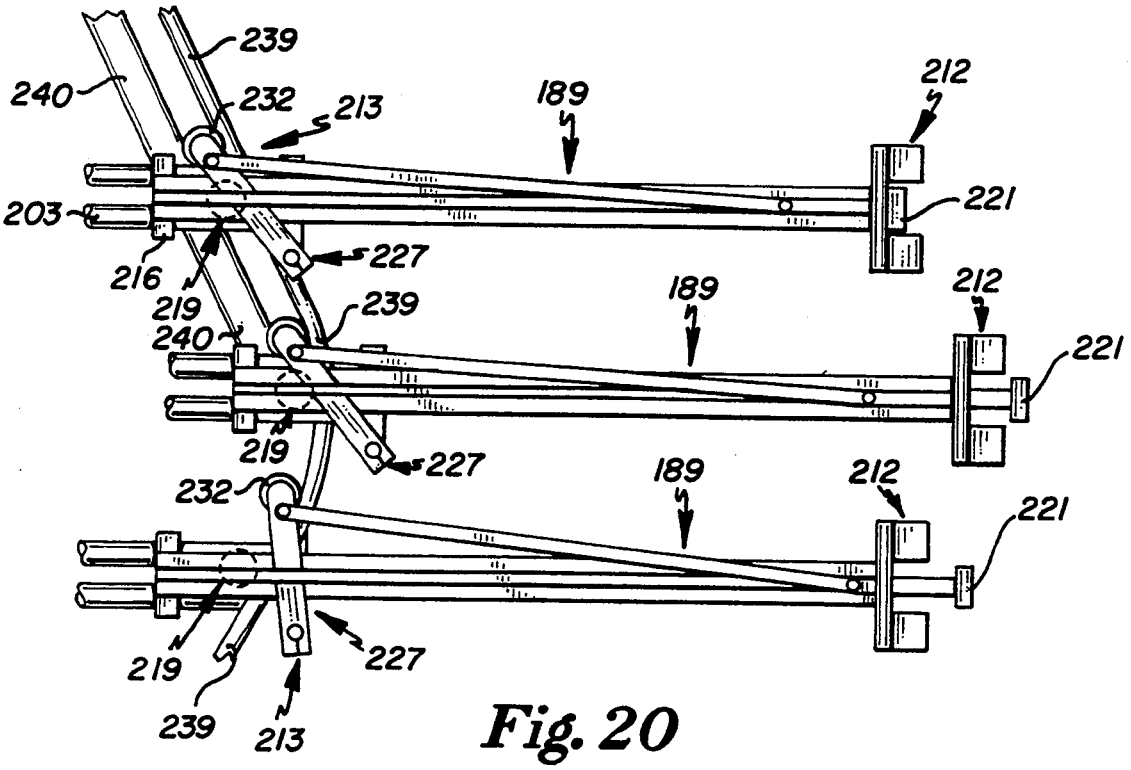
FIG. 20 is a top view of a portion of the cross loader mechanism showing the cooperation of the loader arm assemblies with the cross loader cam assembly and the relative motion thereinbetween.
Figure 21:
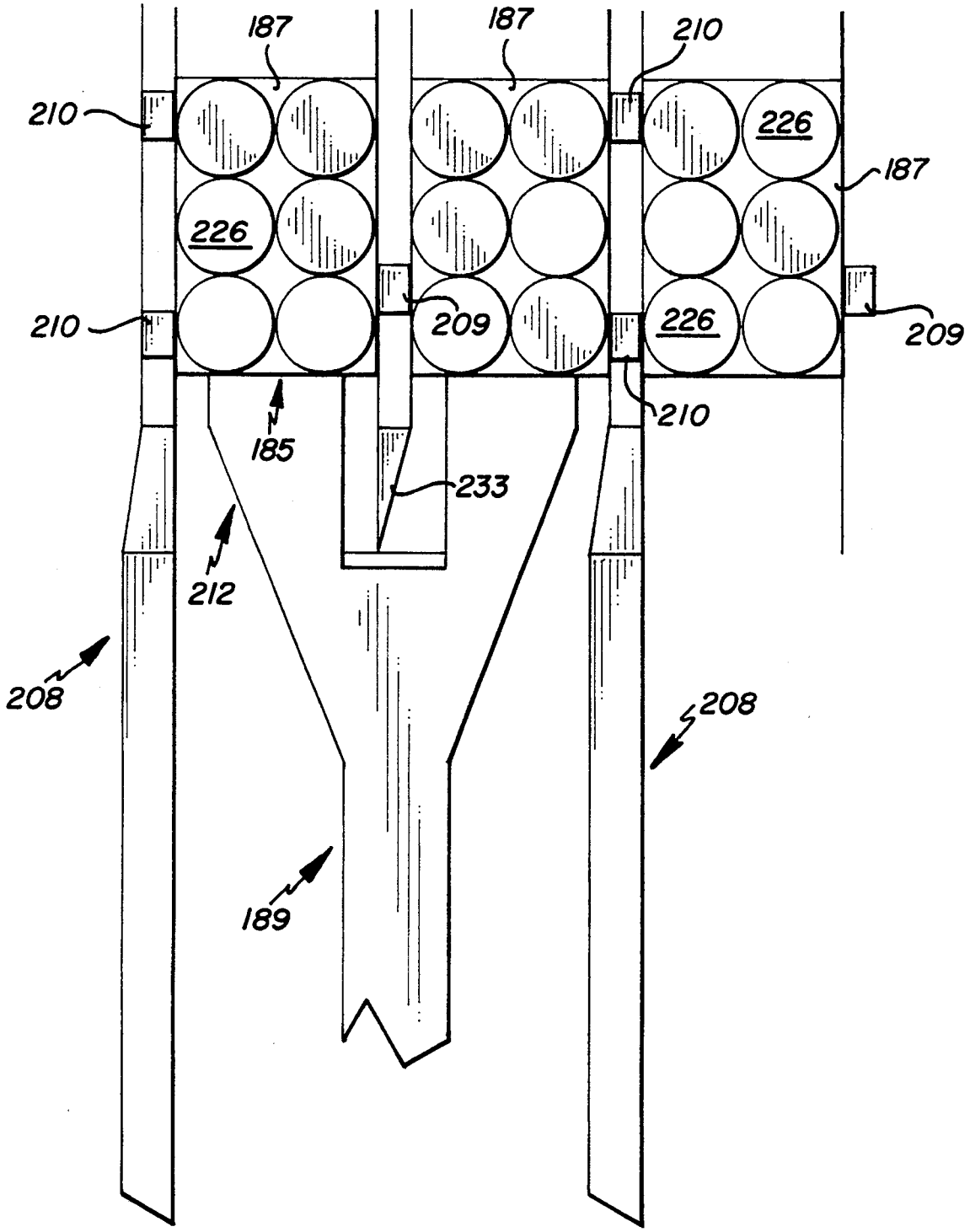
FIG. 21 is a top plan view of an alternative embodiment of the loader head of the arm assembly.

The loader control cam assembly 90 controls the transverse, reciprocal motion of both the overall arm assemblies 189 and the extensible face members 221 of the arm assembly loading heads 212. Referring to FIGS. 13 and 14, the loader control cam assembly 90 is generally oriented longitudinally with respect to the overall cross loading mechanism 183, and has a top or forward run 234 and a bottom or return run 235 corresponding to the revolving arm assemblies 189. The top run 234 basically comprises an inwardly sloping approach segment 236, an active segment 237 located at the apex of the approach segment 236 and involving a change in direction thereof, and an outwardly sloping dwell segment 238. In the approach segment 236, the first or arm cam follower 219 is urged inwardly, with respect to the apparatus 184, and drives each arm assembly 189 into moving engagement with a product group 185 until the product group 185 is loaded in a carton 187. At this point the cam follower 219 is at the apex position of the cam assembly 90. As best shown in FIG. 20, the second or extensible member cam follower 232 is also guided inwardly in the approach segment 236, but since it is linearly aligned and traveling along with the first cam follower 218, no relative movement exists between these two elements 219 and 232. In contrast, as each arm assembly 189 reaches the apex 237 of the cam assembly 90, the first cam follower 219 moves out of linear alignment with the second cam follower 232. The second cam follower 232 no longer moves the arm assembly 189 in a transverse direction, and instead it is propelled only longitudinally. However, the spacially trailing second arm follower continues to undergo transverse movement due to the inwardly sloping cam segment 236, causing the pivot arm 228 to pivot about point 230 and thereby activating the extensible member 221. In the outwardly sloping dwell segment 238, a complete pivot of the pivot arm 228 is accomplished, with resultant full extension of the extensible member 221. Throughout this segment 238, the cam rollers 219 and 232 are once again linearly aligned during travel and therefore no further relative motion occurs. Each arm assembly 189 is retracted by the outward movement of the cam roller 219. In the return run 235 of the cam assembly 90, the arm assemblies 189 are longitudinally returned to the forward run 234 and undergo no transverse motion. Additionally, the pivot arm 228 is reset in the return run 235 to its position in the approach segment 236. Still referring to FIG. 20, the forward run 234 of the cam assembly 90 comprises a continuous inner rail 239 which extends the entire length of the top run 234, and an outer rail 240 which extends the length of the approach segment 236 and is spaced from the inner rail 239 a distance equivalent to the diameter of the second cam follower 232. The second follower 232 is disposed in a cam pathway between the inner and outer rails 239 and 240 to effectuate transverse, inward motion to the arm assemblies 189. Preferably, the outer rail is connected to a pivot point 241 at it's first end. Its opposite end is connected to a release mechanism (not shown), such as a pressure release cylinder and piston. The release mechanism is controlled by a sensing mechanism, for example, a photoeye or capacitive proximity sensor, such that if an excessive force is placed on the outer rail 240, for example due to a jamming of the arm assembly 189, the release mechanism will be actuated releasing the outer rail 240 which pivots about point 241.

As many changes are possible to the embodiments of this invention utilizing the teachings thereof, the descriptions above, and the accompanying drawings should be interpreted in the illustrative and not the limited sense.

That which is claimed is:

1. A lateral transfer apparatus for use in an article processing system of the type wherein articles or article groups are transported in one or more longitudinally oriented streams, comprising:

a) a frame structure;

b) a plurality of transfer elements disposed at predetermined longitudinally spaced intervals, said transfer elements being for laterally moving articles which are being longitudinally transported in at least one stream of the article processing system, each said transfer element including a stepped contact member for moveable contact with the article, a support member connected to said contact member, and a control member for directing the lateral movement of said transfer elements, said control member including a first cam follower connected to said support member and controlling lateral movement of said transfer elements, and a second cam follower pivotally connected to said support member and further being connected to said contact member via linkage means, said second cam follower providing differential lateral movement to said stepped contact member;

c) means to longitudinally move said transfer elements, said longitudinal movement means being connected to said support member; and d) a cam track assembly having a predetermined configuration for laterally moving said transfer elements, said cam track assembly being cooperatively mated with said first and second cam followers.

2. The apparatus of claim 1, wherein said transfer elements are constructed and arranged along an endless longitudinally oriented loop to be conveyed longitudinally in a top, forward run and a bottom, return run on said frame structure.

3. The apparatus of claim 1, wherein said support member comprises a laterally oriented, elongated base member having a first end at which said contact member is disposed and a second end, at least one bearing block disposed proximate each said base member end, and at least one slide rail aligned and disposed spacially parallel with respect to said base member and slidably mated with said bearing blocks, said slide rail further being connected to said longitudinal movement means.

4. The apparatus of claim 3, wherein there are two parallel and slightly spaced apart slide rails, wherein said base member has a horizontal plate and a vertical bar, wherein first and second, spaced apart bearing blocks are disposed proximate said second end, each connected to said horizontal plate and being slidably coupled with said slide rails, and wherein a third bearing block is disposed proximate said first end, said third bearing block being connected to said slide rails and slidably coupled to said horizontal plate.

5. The apparatus of claim 1, wherein said control member further comprises a coupling member connected to said at least one bearing block, said first cam follower being horizontally, rotatably disposed on said coupling member, and an arm member pivotally connected at a first end thereof to said at least one bearing block at said second end, said second cam follower being horizontally, rotatably disposed on said arm member at a second end thereof.

6. The apparatus of claim 1, wherein said cam track configuration provides a constant rate of lateral extension to said transfer elements throughout a majority of a total extension path of each said transfer element, said cam track configuration further providing a decreased rate of lateral extension at a predetermined segment of said transfer element extension path for making smooth contact with the article.

7. The apparatus of claim 2, wherein said longitudinal movement means comprises a pair of parallel, spaced driven chains each supported by a rectilinear guide along a top, forward longitudinal run thereof, each said support member slide rail being connected at one end to one chain and at an opposite end to the other chain.

8. The apparatus of claim 1, wherein the apparatus is used to load article groups comprising at least one article into open sides of synchronized article packages in a continuous packaging process.

9. The apparatus of claim S, wherein each article group is disposed on a dead plate and aligned for entry into a package, wherein the dead plate has an elongated, laterally oriented slot of a predetermined width, and wherein the apparatus further comprises a stabilization member disposed on said base member for mating insertion into the dead plate slot during lateral extension of said transfer elements.

10. A lateral transfer apparatus for use in a continuous packaging system of the type wherein article groups comprising at least one article being transported in a longitudinally oriented stream are loaded into open sides of synchronized article packages traveling in a second longitudinal stream, comprising:

a) a frame structure;

b) an article group transport stream wherein each article group is disposed on a dead plate and aligned for entry into a package, wherein the dead plate has an elongated, laterally oriented slot of a predetermined width;

c) a plurality of transfer elements disposed at predetermined longitudinally spaced intervals, said transfer elements being for laterally moving article groups which are being longitudinally transported in said article group transport stream;

d) means to longitudinally move said transfer elements;

e) means to laterally move said transfer elements; and f) a stabilization member disposed on each said transfer element for mating insertion into said dead plate slot during lateral extension of said transfer elements.

11. The apparatus of claim 10, wherein the apparatus is used to load article groups comprising at least one article into open sides of synchronized article packages in a continuous packaging process, wherein each article group is disposed on a dead plate and aligned for entry into a package, wherein the dead plate has an elongated, laterally oriented slot of a predetermined width, and wherein said stabilization member is inserted into the dead plate slot during lateral extension of said transfer elements.

12. The apparatus of claim 10, wherein said transfer elements are constructed and arranged along an endless longitudinally oriented loop to be conveyed longitudinally in a top, forward run and a bottom, return run on said frame structure.

13. The apparatus of claim 10, wherein said transfer elements comprise a contact member for contact with the article, a support member connected to said contact member and to said longitudinal movement means, and a control member connected to said support member and to said lateral movement means to direct the lateral movement of said transfer elements.

14. The apparatus of claim 13, wherein said support member comprises a laterally oriented, elongated base member having a first end at which said contact member is disposed and a second end, at least one bearing block disposed proximate each said base member end, and at least one slide rail aligned and disposed spacially parallel with respect to said base member and slidably mated with said bearing blocks, said slide rail further being connected to said longitudinal movement means.

15. The apparatus of claim 14, wherein there are two parallel and slightly spaced apart slide rails, wherein said base member has a horizontal plate and a vertical bar, wherein first and second, spaced apart bearing blocks are disposed proximate said second end, each connected to said horizontal plate and being slidably coupled with said slide rails, and wherein a third bearing block is disposed proximate said first end, said third bearing block being connected to said slide rails and slidably coupled to said horizontal plate.

16. The apparatus of claim 14, wherein said lateral movement means comprises a cam track having a predetermined configuration.

17. The apparatus of claim 16, wherein said contact member has a fixed configuration.

18. The apparatus of claim 16, wherein said contact member has a movable, stepped configuration.

19. The apparatus of claim 17, wherein said control member comprises a cam follower connected to said support member, said cam follower being cooperatively mated with said cam track.

20. The apparatus of claim 19, wherein said control member further comprises a coupling member connected to said at least one bearing block at said second end, and wherein said cam follower is horizontally rotatably disposed on said coupling member.

21. The apparatus of claim 18, wherein said control member comprises a first cam follower connected to said support member and cooperatively mated with said cam track to control movement of said transfer elements, and a second cam follower pivotally connected to said support member and further being connected to said contact member via linkage means, said second cam follower being cooperatively mated with said cam track to provide differential lateral movement to said stepped contact member.

22. The apparatus of claim 21, wherein said control member further comprises a coupling member connected to said at least one bearing block, said first cam follower being horizontally, rotatably disposed on said coupling member, and an arm member pivotally connected at a first end thereof to said at least one bearing block at said second end, said second cam follower being horizontally, rotatably disposed on said arm member at a second end thereof.

23. The apparatus of claim 16, wherein said cam track configuration provides a constant rate of lateral extension to said transfer elements throughout a majority of a total extension path of each said transfer element, said cam track configuration further providing a decreased rate of lateral extension at a predetermined segment of said transfer element extension path for making smooth contact with the article.

24. The apparatus of claim 14, wherein said longitudinal movement means comprises a pair of parallel, spaced driven chains each supported by a rectilinear guide along a top, forward longitudinal run thereof, each said support member slide rail being connected at one end to one chain and at an opposite end to the other chain.

25. A lateral transfer apparatus for use in an article processing system of the type wherein articles or article groups are transported in one or more longitudinally oriented streams, comprising:

a) a frame structure;

b) a plurality of transfer elements disposed at predetermined longitudinally spaced intervals, said transfer elements being for laterally moving articles which are being longitudinally transported in at least one stream of the article processing system, each said transfer element including a contact member for contact with the article, a support member connected to said contact member, and a control member for directing the lateral movement of said transfer elements, said control member including at least one cam follower connected to said support member and controlling lateral movement of said transfer elements;

c) means to longitudinally move said transfer elements, said longitudinal movement means being connected to said support member; and d) a cam track assembly having a predetermined configuration for laterally moving said transfer elements, said cam track assembly being cooperatively mated said with at least one cam follower, said cam track configuration providing a constant rate of lateral extension to said transfer elements throughout a majority of a total extension path of each said transfer element, said cam track configuration further providing a decreased rate of lateral extension at a predetermined segment of said transfer element extension path for making smooth contact with the article.

26. The apparatus of claim 25, wherein said transfer elements are constructed and arranged along an endless longitudinally oriented loop to be conveyed longitudinally in a top, forward run and a bottom, return run on said frame structure.

27. The apparatus of claim 25, wherein said support member comprises a laterally oriented, elongated base member having a first end at which said contact member is disposed and a second end, at least one bearing block disposed proximate each said base member end, and at least one slide rail aligned and disposed spacially parallel with respect to said base member and slidably mated with said bearing blocks, said slide rail further being connected to said longitudinal movement means.

28. The apparatus of claim 27, wherein there are two parallel and slightly spaced apart slide rails, wherein said base member has a horizontal plate and a vertical bar, wherein first and second, spaced apart bearing blocks are disposed proximate said second end, each connected to said horizontal plate and being slidably coupled with said slide rails, and wherein a third bearing block is disposed proximate said first end, said third bearing block being connected to said slide rails and slidably coupled to said horizontal plate.

29. The apparatus of claim 25, wherein said contact member has a fixed configuration.

30. The apparatus of claim 25, wherein said contact member has a movable, stepped configuration.

31. The apparatus of claim 29, wherein said control member comprises a single cam follower connected to said support member, said cam follower being cooperatively mated with said cam track.

32. The apparatus of claim 31, wherein said control member further comprises a coupling member connected to said at least one bearing block at said second end, and wherein said cam follower is horizontally rotatably disposed on said coupling member.

33. The apparatus of claim 30, wherein said control member comprises two cam followers, a first cam follower connected to said support member and cooperatively mated with said cam track to control movement of said transfer elements, and a second cam follower pivotally connected to said support member and further being connected to said contact member via linkage means, said second cam follower being cooperatively mated with said cam track to provide differential lateral movement to said stepped contact member.

34. The apparatus of claim 33, wherein said control member further comprises a coupling member connected to said at least one bearing block, said first cam follower being horizontally, rotatably disposed on said coupling member, and an arm member pivotally connected at a first end thereof to said at least one bearing block at said second end, said second cam follower being horizontally, rotatably disposed on said arm member at a second end thereof.

35. The apparatus of claim 26, wherein said longitudinal movement means comprises a pair of parallel, spaced driven chains each supported by a rectilinear guide along a top, forward longitudinal run thereof, each said support member slide rail being connected at one end to one chain and at an opposite end to the other chain.

36. The apparatus of claim 25, wherein the apparatus is used to load article groups comprising at least one article into open sides of synchronized article packages in a continuous packaging process.

37. The apparatus of claim 36, wherein each article group is disposed on a dead plate and aligned for entry into a package, wherein the dead plate has an elongated, laterally oriented slot of a predetermined width, and wherein the apparatus further comprises a stabilization member disposed on said base member for mating insertion into the dead plate slot during lateral extension of said transfer elements.

* * * * *